United States Patent [19]

Talbot

[11] Patent Number: 5,056,789

[45] Date of Patent: Oct. 15, 1991

[54] BALL SEQUENCING GAME

[76] Inventor: Derek J. Talbot, 188 Bastable Ave. Thames View Estate, Barking, Essex, United Kingdom

[21] Appl. No.: 519,809

[22] Filed: May 7, 1990

[51] Int. Cl.[5] ..... A63F 7/02; A63F 9/06

[52] U.S. Cl. ..... 273/153 R; 446/168

[58] Field of Search ..... 273/153 R, 120; 446/168; 434/188, 189

[56] References Cited

U.S. PATENT DOCUMENTS

| | | | |
|---|---|---|---|
| 934,203 | 9/1909 | McCauley | 273/153 R |
| 2,613,937 | 10/1952 | Kitson | 273/120 R |
| 2,686,386 | 8/1954 | Booth | 446/168 |
| 2,872,194 | 2/1959 | Kellinger | 446/168 X |
| 2,998,673 | 9/1961 | Rhodes | 273/120 R X |
| 3,095,655 | 7/1963 | Berglund et al. | 434/188 |
| 3,540,731 | 11/1970 | Muncey | 273/153 R X |
| 3,638,350 | 2/1972 | Wiggen | 446/168 |
| 3,638,945 | 2/1972 | Breslow | 273/120 R X |
| 3,851,879 | 12/1974 | Hicks | 273/120 R |
| 4,395,041 | 7/1983 | Goldfarb et al. | 446/168 X |

*Primary Examiner*—William H. Grieb

*Attorney, Agent, or Firm*—Leon Gilden

[57] ABSTRACT

A game housing includes a series of angulated ramps arranged vertically underlying one another, with a predetermined column of contrastingly colored or enumerated spheres positioned adjacent the bottommost ramp. The housing includes a slide defining an upper end of the housing, wherein the slide, upon retraction from a first retracted position to a second extended position, permits descent simultaneously of a series of spheres to the uppermost ramp. "L" shaped lever plates are selectively withdrawn from the ramp to permit descent of a predetermined number of spheres from the ramp to ultimately position and arranged the spheres directed along the ramps to align with the aforenoted column of spheres.

5 Claims, 4 Drawing Sheets

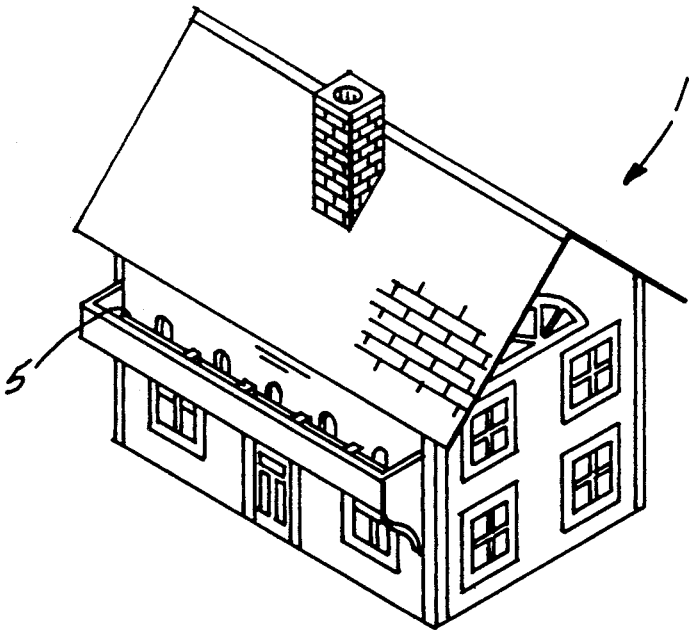
FIG 1
PRIOR ART
FIG 2
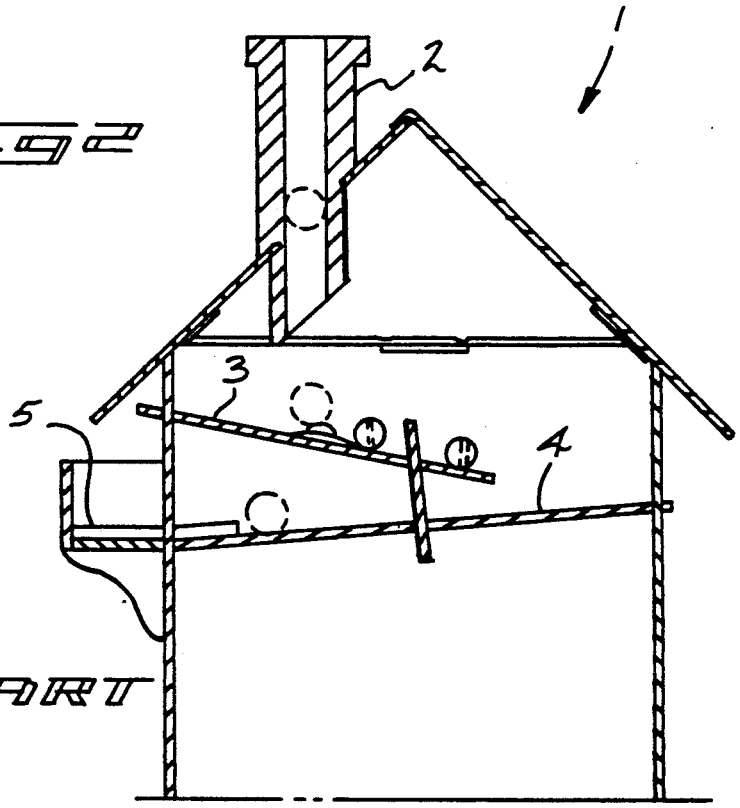
PRIOR ART

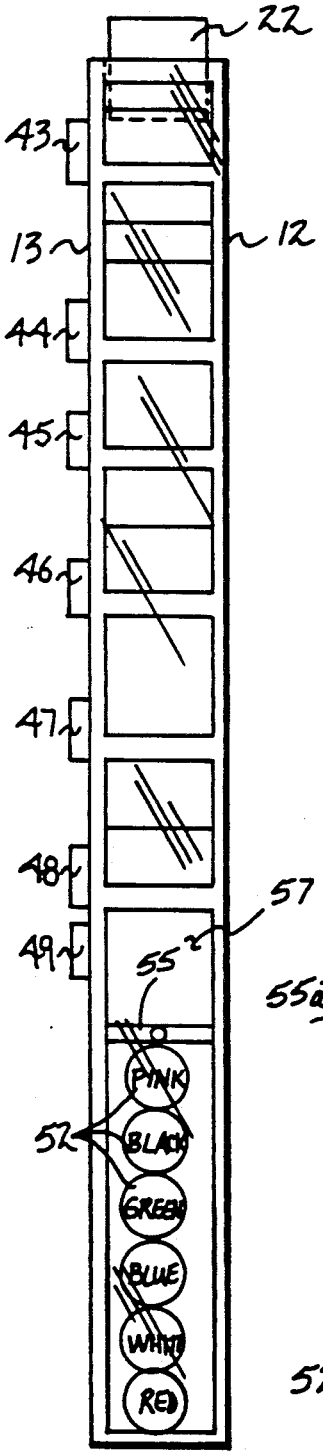
Fig 5
Fig 7
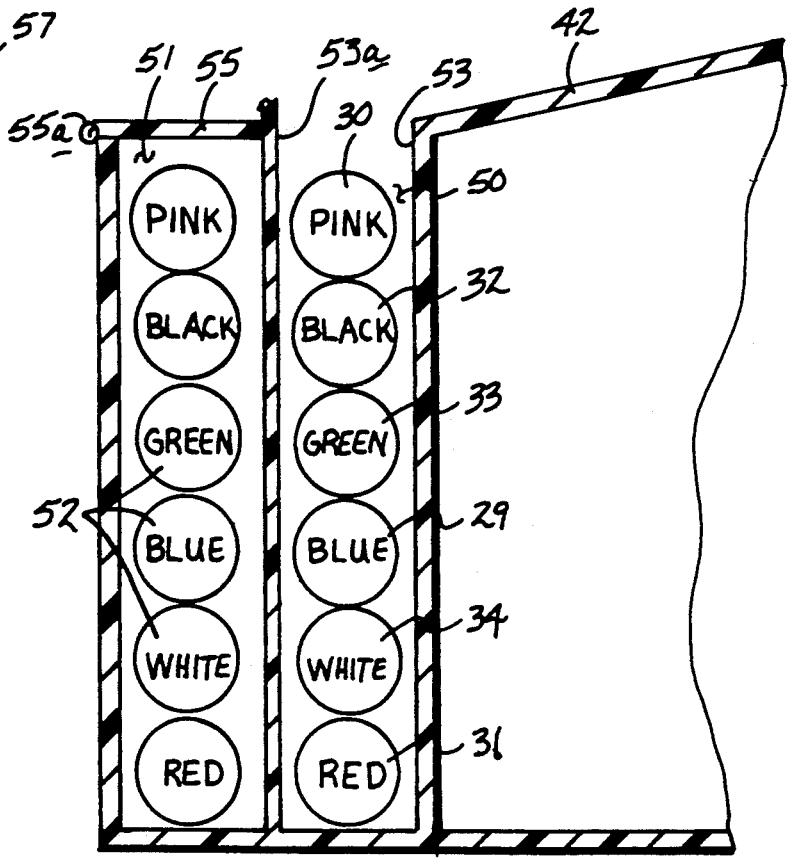

BALL SEQUENCING GAME

BACKGROUND OF THE INVENTION

1. Field of the Invention

The field of invention relates to marble games, and more particularly pertains to a new and improved ball sequencing game wherein the same directs a series of spheres along sequentially positioned ramps to ultimately align the spheres with target spheres positioned at a lowermost end of the lowermost ramp.

2. Description of the Prior Art

Ball sequencing games of various types have been provided in the prior art. The prior art has heretofore utilized such sequencing structure to arrange spheres in various manners for amusement and entertainment of individuals. Examples of the prior art includes U.S. Pat. No. 2,613,937 to Kitson wherein a toy-type house permits directing a sphere initially through a chimney and ultimately through a plurality of ramps within the house, with compartments to direct the spheres to a structural portion of the arrangement exteriorly of the house.

U.S. Pat. No. 3,638,350 to Wiggen sets forth a toy wherein the plurality of balls or marbles are controlled by manipulation of a ball supporting surface to one or more circular paths defined by annular shoulders within the housing of the organization.

U.S. Pat. No. 2,872,194 to Kellinger sets forth a column of target balls positioned in a target, wherein the target balls may be discharged upon being struck by a missile ball mounted within a column within the apparatus.

U.S. Pat. No. 2,998,673 to Rhodes sets forth an amusement device wherein spherical balls are directed through a predetermined trajectory upon an initial descent to arrange the spheres in a predetermined position within the organization.

U.S. Pat. No. 4,395,041 to Goldfarb, et al. sets forth a ball transfer and capture game wherein balls are directed in a predetermined relationship through the organization in a prescribed manner about various turntable type arrangements.

As such, it may be appreciated that there continues to be a need for a new and improved ball sequencing game as addressed by the instant invention wherein the same directs itself to the amusement and entertainment of individuals utilizing a novel spherical directing ramp structure.

SUMMARY OF THE INVENTION

In view of the following disadvantages inherent in the known types of ball game devices now present in the prior art, the present invention provides a ball sequencing game wherein the same permits individuals to methodically direct a series and array of spheres throughout an inner relationship of ramps within the organization to ultimately position the spheres within a predetermined order at a lowermost portion of the housing of the game. As such, the general purpose of the present invention, which will be described subsequently in greater detail, is to provide a new and improved ball sequencing game which has all the advantages of the prior art ball game devices and none of the disadvantages.

To attain this, the present invention provides a game housing including a series of angulated ramps arranged vertically underlying one another, with a predetermined column of contrastingly colored or enumerated spheres positioned adjacent the bottommost ramp. The housing includes a slide defining an upper end of the housing, wherein the slide retraction from a first retracted position to a second extended position, permits descent simultaneously of a series of spheres to the uppermost ramp. "L" shaped lever plates are selectively withdrawn from t ramp to permit descent of a predetermined number of spheres from the ramp to ultimately position and arrange the sphere directed along the ramps to align with the aforenoted column of spheres.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a base for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims nor is it intended to be limiting as to the scope of the invention in any way.

It is therefore an object of the present invention to provide a new and improved ball sequencing game which has all the advantages of the prior art ball game devices and none of the disadvantages.

It is another object of the present invention to provide a new and improved ball sequencing game which may be easily and efficiently manufactured and marketed.

It is a further object of the present invention to provide a new and improved ball sequencing game which is of a durable and reliable construction.

An even further object of the present invention is to provide a new and improved ball sequencing game which is susceptible of a low cost of manufacture with regard to both material and labor, and which accordingly is then susceptible of low prices of sale to the consuming public, thereby making such ball sequencing games economically available to the buying public.

Still yet another object of the present invention is to provide a new and improved ball sequencing game which provides in the apparatuses and methods of the prior art some of the advantages thereof, while simultaneously overcoming some of the disadvantages normally associated therewith.

Still another object of the present invention is to provide a new and improved ball sequencing game wherein the same requires attention and diligence of participants to direct an array of balls through a series of gates and ramps to ultimately position the spheres in a predetermined array.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art ball sequencing game.

FIG. 2 is an orthographic cross-sectional view of the prior art game, as illustrated in FIG. 1.

FIG. 6 is an isometric illustration of a representative ram structure utilized by the instant invention.

FIG. 7 is an orthographic view of the lowermost end of the last or bottommost ramp in association with target spheres utilized by the instant invention arranged in a column adjacent the column of spheres, a result of traverse down the lowermost ramp by the spheres utilized in the instant invention.

DESCRIPTION OF THE PREFERRED EMBODIMENT

Figure 3:
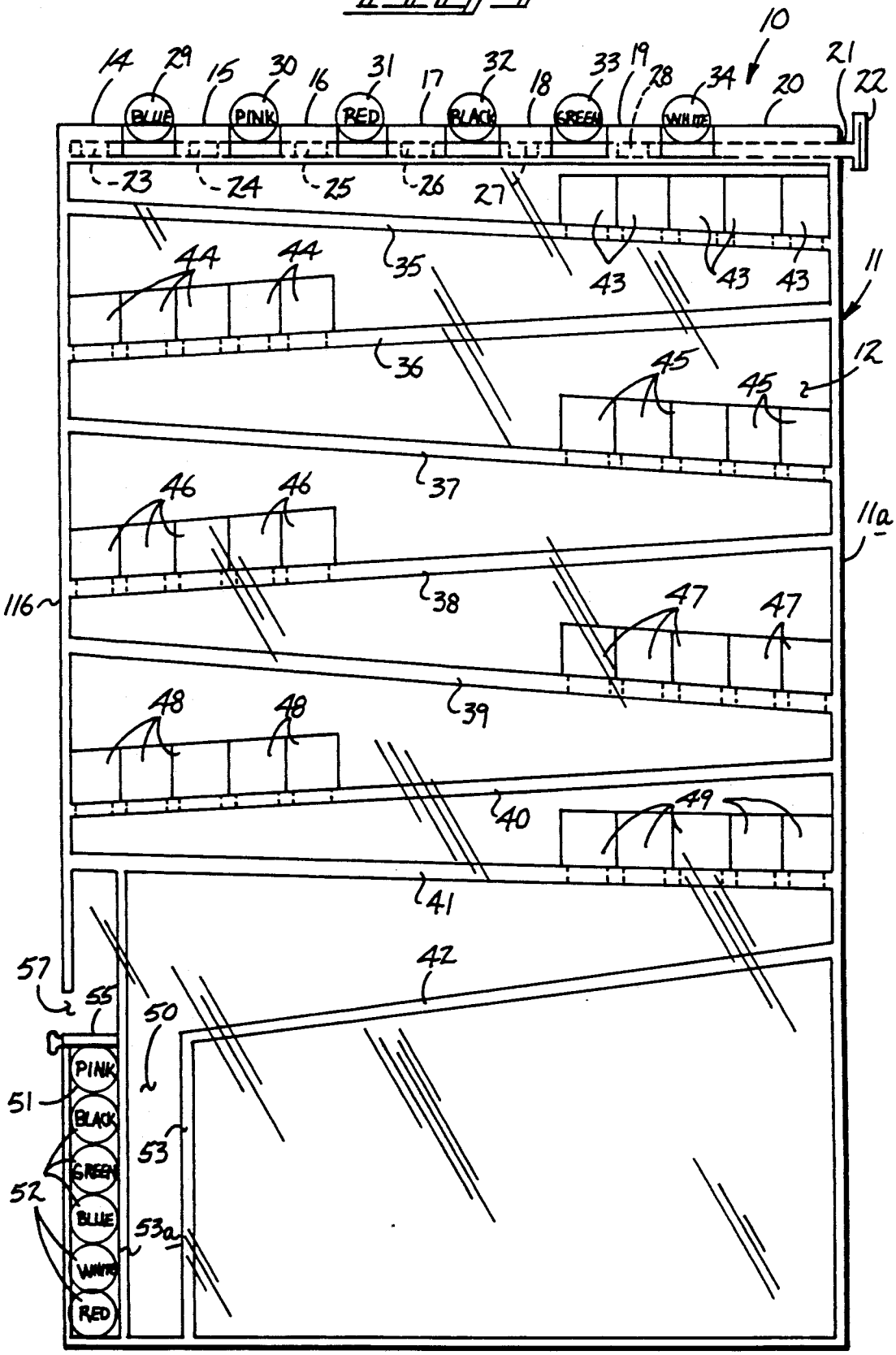
FIG. 3 is a orthographic view, taken in elevation, of the structure of the instant invention.

With reference now to the drawings, and in particular to FIGS. 1 through 7 thereof, a new and improved ball sequencing game embodying the principles and concepts of the present invention and generally designated by the reference numeral 10 will be described.

FIG. 1 illustrates a prior art ball sequencing game 1 wherein an external structure 5 relative to the housing 2 receives spheres directed initially through the chimney, then through a first and second ramp 3 and 4 respectively to direct the ball to a structure 5.

Figure 4:
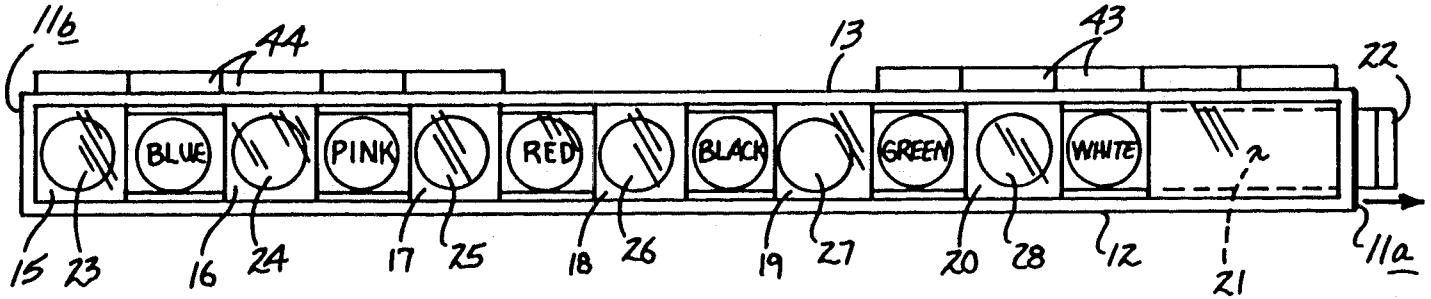
FIG. 4 is an orthographic top view of the instant invention.
Figure 5:
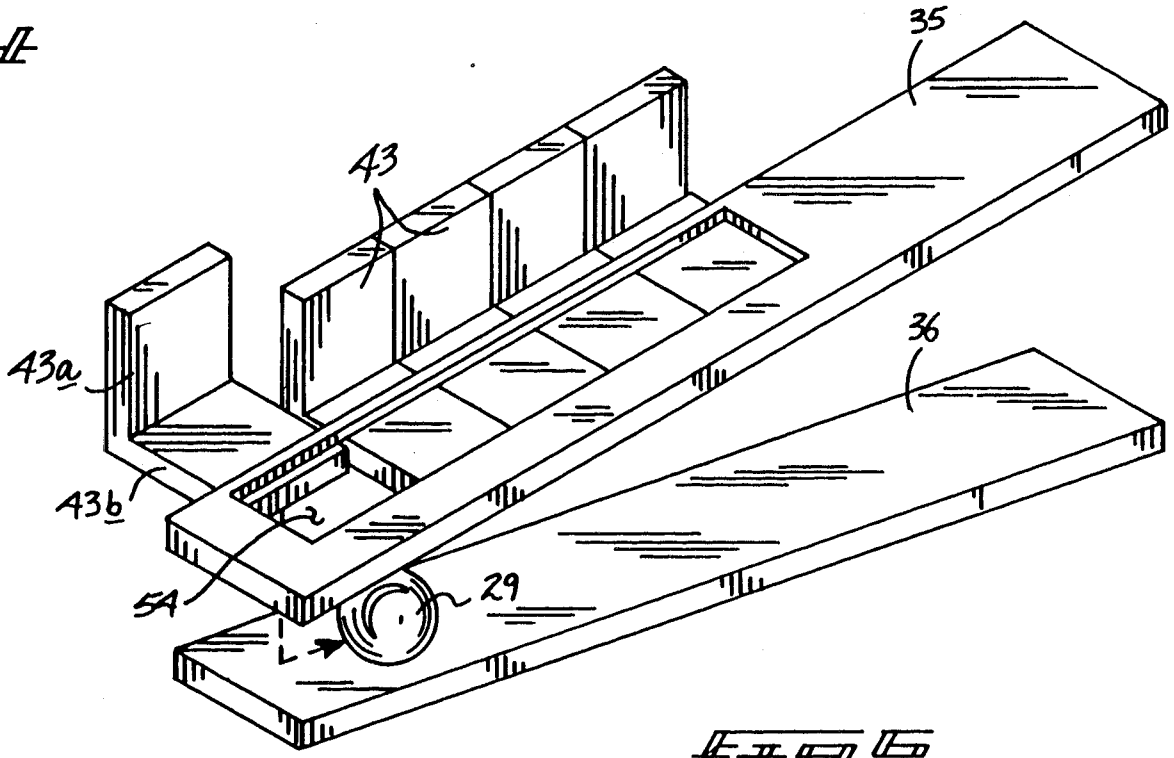
FIG. 5 is an orthographic side view of the instant invention.

More specifically, the ball sequencing game 10 of the instant invention essentially comprises a housing 11 of a generally rectangular parallelepiped configuration, including spaced planar side walls, including a first side wall 11*a* spaced from a parallel to a second side wall 11*b*. The housing and the walls are transparent and further include a rear transparent wall 12 spaced from and parallel to a frontal transparent wall 13. The upper end of the housing 11 includes a series of slotted projections whose slots define an equal coextensively aligned parallelepiped opening to slidably receive an elongated slide plate 21 therethrough. The projection bosses define a first, second, third, fourth, fifth, sixth and seventh aligned slotted projection 14, 15, 16, 17, 18, 19, 20 respectively. The slide plate 21 includes a handle member 22 orthogonally affixed to a free terminal end of the slide plate extending exteriorly of the first side wall 11*a*, as illustrated in FIG. 3. The slide plate includes a series of cylindrical openings initially positioned within each of the slotted projections 14 through 19, as illustrated in FIGS. 3 and 4, in a retracted first position, wherein the cylindrical openings are positioned in an extended second position within spaced gaps between each of the slotted projections to underlie associated sphere. The cylindrical openings are defined by a first, second, third, fourth, fifth, and sixth cylindrical opening 23, 24, 25, 26, 27, and 28 respectively. A series of contrastingly colored or enumerated spheres defined by a first, second, third, fourth, fifth, and sixth sphere 29, 30, 31, 32, 33, and 34 positioned initially adjacent a respective first through sixth slotted projection 14–19. When the slide plate 21 is extended to the second position, and the opening 23–28 underlie each of the associated spheres, the spheres are permitted to simultaneously effect descent onto an underlying first ramp, as illustrated in FIG. 3 for example. A series of sequentially underlying ramps of opposed inclinations to adjacent ramps is positioned throughout the housing underlying the slide plate 21. The ramps include a first ramp 35 underlying the slide plate 21 sloping downwardly from the second side wall 11*b* to the first slide wall 11*a*. A sequentially positioned underlying second ramp 36 underlying the first ramp 35 is inclined from an upper position secured to the first side wall 11*a* to a lowermost position secured to the second side wall 11*b*. Partially positioned underlying respective ramps defining a third ramp 37, a fourth ramp 38, a fifth ramp 39, a sixth ramp 40, a seventh ramp 41, and an eighth ramp 42 are secured to the opposing side walls (with the exception of the eight ramp 42) in alternating inclinations between the first and second side walls 11*a* and 11*b* respectively. The eighth ramp 42 integrally secured to the first side wall 11*a* is directed downwardly and is of a length less than the predetermined width of the front and rear walls to include a first column side wall 53 directed orthogonally downwardly to a lowermost floor of the housing 11. A second column side wall 53*a* is spaced from the first side wall at a predetermined distance substantially equal to a defined diameter by each of the spheres 29–34. The second column side wall 53*a* is spaced from the second side wall 11*b* the predetermined spacing to receive a column of six target spheres 52 of various colorations or enumerations formed within a second column 51 spaced from the first column 50 defined by the first and second column side walls. The first column 50 is replenished by selective target spheres 52 through an associated removable confinement web 55 including a web handle 55*a* to permit insertion of the target spheres 52 therewithin through an associated window 57.

Each of the first through seventh ramps 35–41 includes a series of "L" shaped gates. The gates are positioned in a contiguous aligned relationship in an individual series associated with each ramp of the ramps 35–41. The individual gates each include a vertical plate orthogonally mounted to a horizontal plate, wherein the horizontal plate of each of the "L" shaped gates is slidably received within each of the ramps. The gates include a series of five gates per ramp comprising a series of first "L" shaped gates 43 associated with the first ramp 35, a second series of "L" shaped gates 44 associated with the second "L" shaped ramp 36, a third "L" shaped series of five gates 45 associated with the third ramp 37, a fourth series of "L" shaped gates 46 associated with the fourth ramp 38, a fifth series of "L" shaped gates 47 associated with the fifth ramp 39, a sixth series of "L" shaped gates 48 associated with the sixth ramp 40, and a seventh series of five "L" shaped gates 49 associated with the seventh ramp 41. Each of the respective series of "L" shaped gates are positioned adjacent a side wall and mounted to be received within an associated enclosed slot within each respective ramp. The gates are also arranged ajacent to and extending rearwardly of a lowermost terminal end of each of the respective ramps extending upwardly along each respective ramp from an associated side wall, as illustrated in FIG. 3. Each enclosed slot is of a construction identical to that as illustrated in FIG. 6 in association with the first and second respective ramps 35 and 36. The enclosed slot 54 is opened, wherein each of the horizontal plates of each of the "L" shaped gates is received to be positioned within the slot to prevent a sphere from being directed through the slot when the associated "L" shaped gate is in a first position mounted within the slot as illustrated to a second position retracted from the slot, as illustrated in FIG. 6, to permit a particular sphere to descend downwardly to an underlying ramp. As exemplified in FIG. 6, the first "L" shaped gates 43 each include a vertical plate 43*a* and a horizontal plate 43*b*, wherein the horizontal plate 43*b* is received within the enclosed slot 54.

The object of the game is to align the spheres 29–34 in association with a target sphere 52, as illustrated in FIG. 7.

To this end, the game includes twenty marbles of twelve differnt colorations to permit a positioning of six target marbles within the second column 51. The game may be played by one or more players, either working together or against one another, wherein the game may be concluded by one person and then a subsequent player. Alternatively, group of players may work in teams to effect alignment of the spheres 29–34 with the target spheres 52. The rules require that if one of the "L" shaped gates is pulled outwardly to permit a descent of the sphere 29–34 therethrough, it must remain open such that any sphere that is positioned rearwardly will descend along with the initial sphere. Upon election of a predetermined number of the "L" shaped gates the individual is going to utilize, this decision must be made at the outset of the game. The game is then permitted to progress until alignment of the marbles is achieved by a player or players, as illustrated in FIG. 7.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A game apparatus comprising, in combination, a transparent housing including a front wall spaced from and parallel to a rear wall, a first side wall spaced from and parallel to a second side wall, the housing including a first predetermined number of slotted projections, each projection mounted to an uppermost end of the housing, wherein the projections each include a slot and each of the slots aligned coextensively relative to one another to define a parallelepiped elongated guideway, a gap defined between each of the projections, and a game sphere mounted within each gap, and a slide mounted within the guideway of the slotted projections, the slide plate including a series of openings directed therethrough, the openings spaced equally apart along the slide and positioned within each of the slots in a first position and positioned within each of the gaps in a second position when the slide is extended from a first retracted position to a second extended position relative to the housing, and a plurality of ramps underlying the slide, the ramps fixedly mounted between the first and second side walls, and each of the ramps arranged at alternating inclinations relative to adjacent ramps, and a lowermost ramp underlying the plurality of ramps, wherein the lowermost ramp is mounted to the first side wall and spaced from a second side wall defining a first column between a forward end of the lowermost ramp spaced from the first side wall and a floor defined by the housing.

2. A game set forth in claim 1 including a second column aligned with and adjacent the first column, the second column including a second column wall parallel to and spaced from the second side wall, and a removable web spaced above the second column, and a predetermined number of target spheres positionable within the second column through the slide web, the slide web reciprocatably mounted between the forward wall and the rear wall through the second side wall.

3. A game as set forth in claim 2 wherein each of the plurality of ramps includes an upper end and a lower end, wherein each lower end of each ramp includes an enclosed slot directed through each ramp to permit directing of games spheres therethrough.

4. A game as set forth in claim 3 wherein each enclosed slot includes a series of gates reciprocatably mounted through the forward wall into each enclosed slot to permit selective closure of each enclosed slot.

5. A game as set forth in claim 4 wherein each gate is defined by an "L" shaped member, each "L" shaped member includes a vertical plate and a horizontal plate, the horizontal plate defined by a horizontal plate width, and a total defined by a sum of plate widths of each horizontal plate of each of the gates equals the predetermined length of each enclosed slot, and each gate selectively removable relative to each enclosed slot to permit descent of a game ball passed each gate.

* * * * *